United States Patent [19]

Schmidt

[11] 4,131,356

[45] Dec. 26, 1978

[54] SHEET FILM PROCESSOR

[75] Inventor: Gunter Schmidt, Malibu, Calif.

[73] Assignee: Cubic Productron, Chula Vista, Calif.

[21] Appl. No.: 574,003

[22] Filed: May 2, 1975

[51] Int. Cl.[2] ..... G03D 17/00; G03D 3/02; G03D 3/08

[52] U.S. Cl. ..... 354/322; 354/339

[58] Field of Search ..... 354/297, 310, 312, 316, 354/319, 320, 321, 322, 339, 315; 134/64 P, 122 P

[56] References Cited

U.S. PATENT DOCUMENTS

| | | | |
|---|---|---|---|
| 2,538,270 | 1/1951 | Pratt et al. | 134/64 P |
| 2,927,503 | 3/1960 | Zollinger | 354/321 X |
| 2,980,006 | 4/1961 | Nieuwenhoven et al. | 354/316 |
| 3,072,310 | 1/1963 | Kunz | 354/339 X |
| 3,435,749 | 4/1969 | Cauwe et al. | 134/122 P |
| 3,559,554 | 2/1971 | Schmidt | 354/310 |
| 3,678,842 | 6/1972 | Reid | 134/64 P |
| 3,712,206 | 1/1973 | Schmidt | 354/322 |
| 3,769,897 | 11/1973 | Zwettler et al. | 354/322 |
| 3,882,525 | 5/1975 | Zwettler | 354/316 |

*Primary Examiner*—Fred L. Braun

*Attorney, Agent, or Firm*—Lindenberg, Freilich, Hornbaker, Wasserman, Rosen & Fernandez

[57] ABSTRACT

A film processor of the type which includes a sheet transport having a finger pushing the rear edge of the film sheet while edge guides guide the edges of the film along a path that leads down into each of a series of tanks and up out of each tank in a loop over to the next tank, including a loop guide at the end of each loop for guiding the middle of the film sheet around the loop. The loop guide includes a pair of guide plates lying near the center of the film path on either side of a finger-moving belt, each plate having a concave surface extending along the radially outside portion of a loop to guide the leading edge of a film sheet which tends to bow outwardly as the sheet moves along a curve.

2 Claims, 7 Drawing Figures

SHEET FILM PROCESSOR

BACKGROUND OF THE INVENTION

This invention relates to apparatus for processing film.

Small film pieces or chips of the type used in dental X-rays can be developed in a machine which employs edge guides to guide the film through each of a group of tanks, and which also has a belt-driven finger which pushes against the rear edge of the film. Such a machine is described in my U.S. Pat. No. 3,712,206 entitled "Chip Film Processor." A similar but larger machine would be very useful in processing larger films, which may be referred to as film sheets, such as the 105 millimeter (4 inch) wide sheets commonly used in hospitals to make multiple exposures during a medical procedure. However, the film sheets are typically not as stiff as the smaller chips, so they tend to fall out of the guiding grooves at loops in the film path and they also tend to deflect around a finger which is pushing the sheet along the film path. A processing machine which could move a highly flexible film sheet through tanks of processing chemicals in an accurately controlled manner, and which minimized damage to the film emulsion, would facilitate the developing of film sheets.

SUMMARY OF THE INVENTION

In accordance with one embodiment of the present invention, a sheet film processor is provided which can reliably guide a highly flexible film sheet along a sinuous path which contains reverse loops that lead through tanks of chemicals and a dryer. The processor includes a transport with beltdriven fingers for pushing the rear edge of a sheet along a film path, side edge guides which form grooves that guide the sides of the film sheet along the film path, and loop guides which guide the middle of the leading edge of the sheet along each loop of the path. Each loop guide includes a pair of plates lying near the middle of the film on either side of the finger-driving belt, with an edge of each plate extending in a loop to guide the leading edge of a sheet along the loop. The loop guides lie slightly outside the loop defined by the side edge guides, so that only the leading and trailing edges of the film sheet contact the loop guides as the sheet bows outwardly when its edges are bent into a loop. At transfer loops, where a sheet coming up out of a tank is guided in a loop over to the next tank, an upper roller is provided between two parts of the loop guide, to engage a film sheet between itself and a lower driven roller which lies thereunder.

The novel features of the invention are set forth with particularity in the appended claims. The invention will best be understood from the following description when read in conjunction with the accompanying drawings.

DESCRIPTION OF THE PREFERRED EMBODIMENTS

Figure 1:
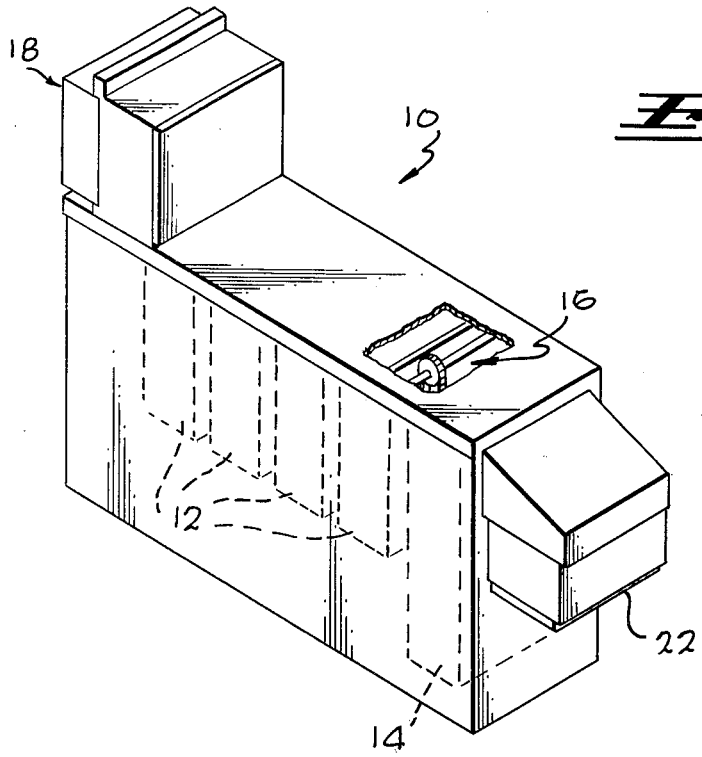
FIG. 1 is a perspective and partially cut-away view of a film processor constructed in accordance with the present invention.
Figure 2:
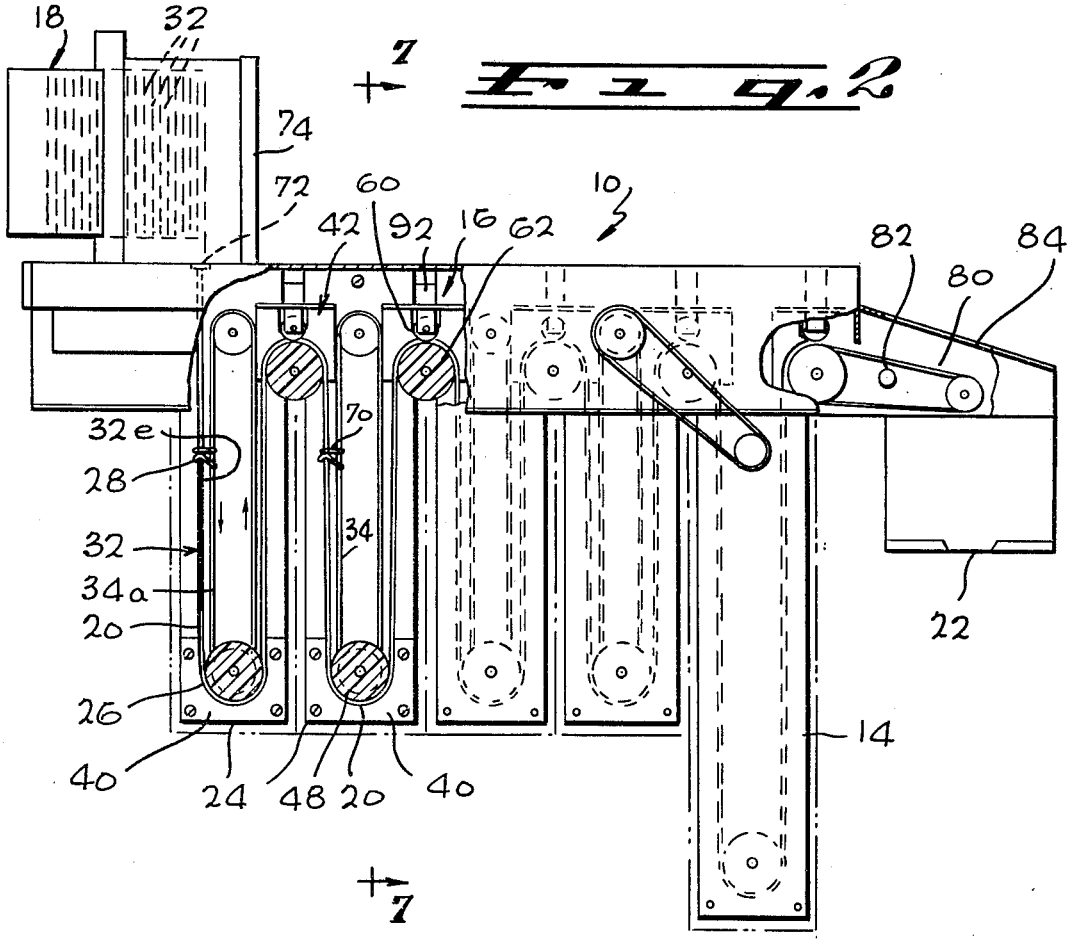
FIG. 2 is a side elevation view of a transport of the processor of FIG. 1.

FIG. 1 illustrates a film processor 10 which includes several chemical tanks 12 and a dryer tank 14, and which includes a sheet transport 16 for moving sheets of film through the tanks. The processor 10 is light-tight so that processing of film sheets can be conducted in an ordinary lighted room. A processor of this type, but with a different transport installed therein, is disclosed in my patent application, Ser. No. 574,002 filed May 2, 1975, now U.S. Pat. No. 4,012,753.

FIGS. 1 – 7 illustrate details of the transport 16 which moves sheets of film 32 contained in a cartridge 18 along a film path 20 that extends through the tanks, and to an output box 22 where the developed sheets are retained until they are picked up. The transport includes side guides 24 (FIG. 3) which form grooves 26 along each side of the film path to engage the side edge of the film sheet and guide the sheet through the processor. The sheet is moved along the processor largely by push fingers 28 which push against the rearward edge 30 of a film sheet 32 to push the sheet along the path. Each of the push fingers 28 is mounted on a chain belt 34 which extends about a pair of pulleys 36, 38, and with the upper pulley 36 being motor-driven. The transport contains five of such belts to move the sheet down into and up out of each of the four chemical-holding tanks and the dryer tank.

A film sheet 32 can be easily moved along straight portions of the film path by a combination of the edge guides 24 whose grooves 26 guide the side edges of the sheet, and by the push finger 28 which pushes against the middle of the rear edge of the sheet. However, it can be difficult to control movement of the sheet around the curves or loops of the film path. This is due to the fact that when the sides of the film are guided along a relatively sharp curve, the sheet tends to bow outwardly along the curve, particularly at the leading edge of the sheet. As the sheet bows, the distance between its side edges decreases, and it is possible for the leading edge to fall out of the grooves 26 of the side edge guides and for the sheet to become tangled in the machine. In order to guide the film sheet, and particularly the middle of the leading edge thereof, around the loops of the film path, loop guides are provided at each loop of the path. It may be noted that in the case of very small sheets or chips of the type used for dental x-rays, the chip stiffness is sufficient that excessive bowing normally does not occur around the curves, and therefore loop guides may not be required in machines of the type described in my earlier U.S. Pat. No. 3,712,206 on a Chip Film Processor.

Figure 5:
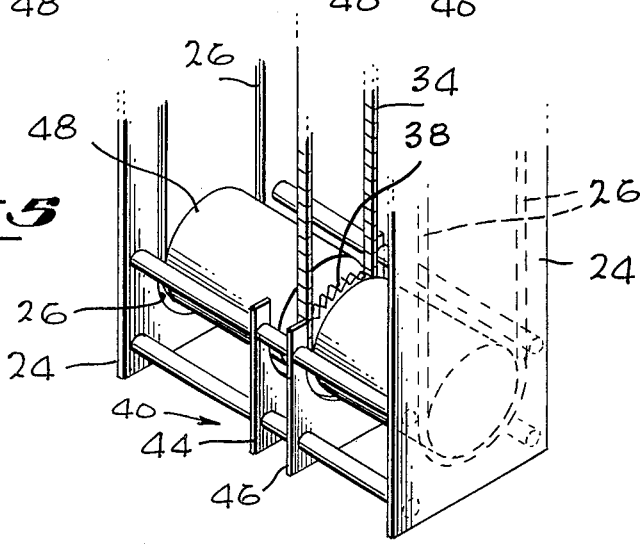
FIG. 5 is a perspective view of a portion of the transport of FIG. 4, showing the path of a film sheet thereon.

The transport 16 includes five lower loop guides 40 and five upper loop guides 42 which are part of five transfer devices. A prime consideration in constructing the guides is to minimize the possibility of damage to the film surface, and particularly to the emulsion on one side **32*e* of the film, since the emulsion is soft and easily scratched during early stages of development. FIG. 5 illustrates the lower loop guide 40 which includes a pair of plates 44, 46 that are located near the center of the film path, on either side of the chain belt 34** but closer to the center of the path than to the grooved edge guides 24. The plates 44, 46 are located slightly outside the loop, such as one-eighth inch outside the loop defined by the side grooves 26, and they normally engage only the leading edge of the film sheet to prevent excessive bowing, although the trailing edge of the sheet can be engaged. By preventing excessive bowing at the leading and trailing edges, the sheet is prevented from bowing so far out that it comes out of the side edge guides. The driven roller 48 assures that the sheet will not fall out of the inside of the loop.

Figure 3:
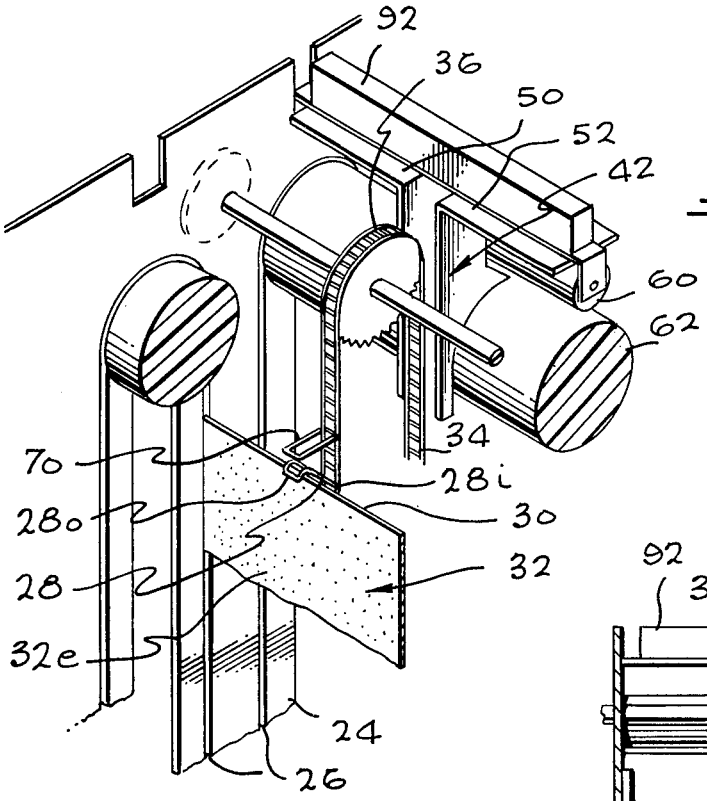
FIG. 3 is a partial perspective view of the transport of FIG. 2.
Figure 6:
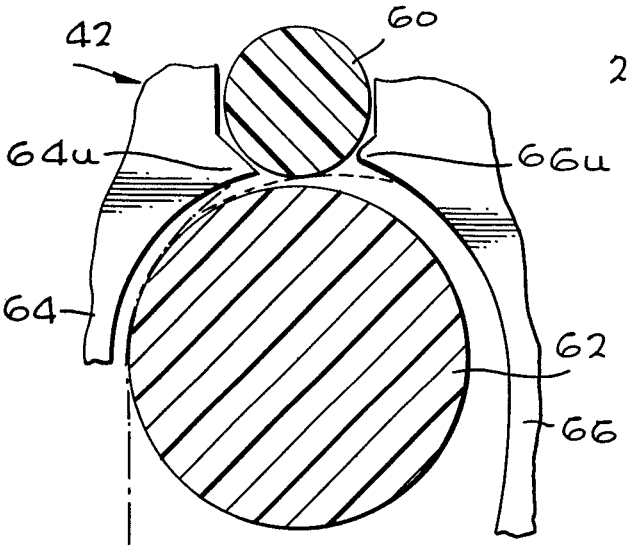
FIG. 6 is an enlarged view of a portion of FIG. 4, showing the path of the leading portion of a film sheet as it traverses a loop.
Figure 7:
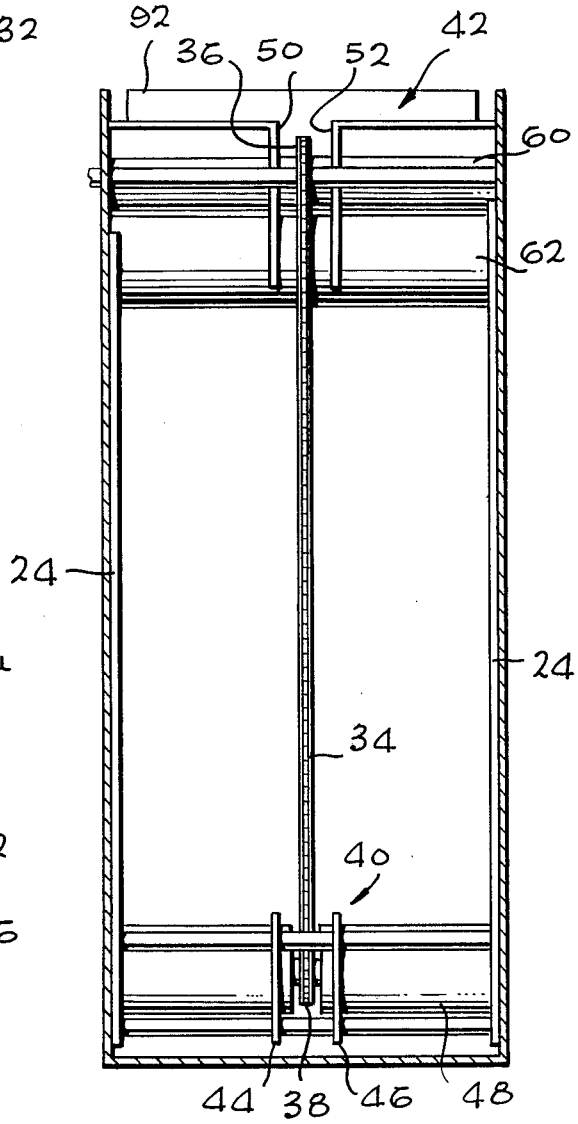
FIG. 7 is a view taken on the line 6—6 of FIG. 2.
Figure 4:
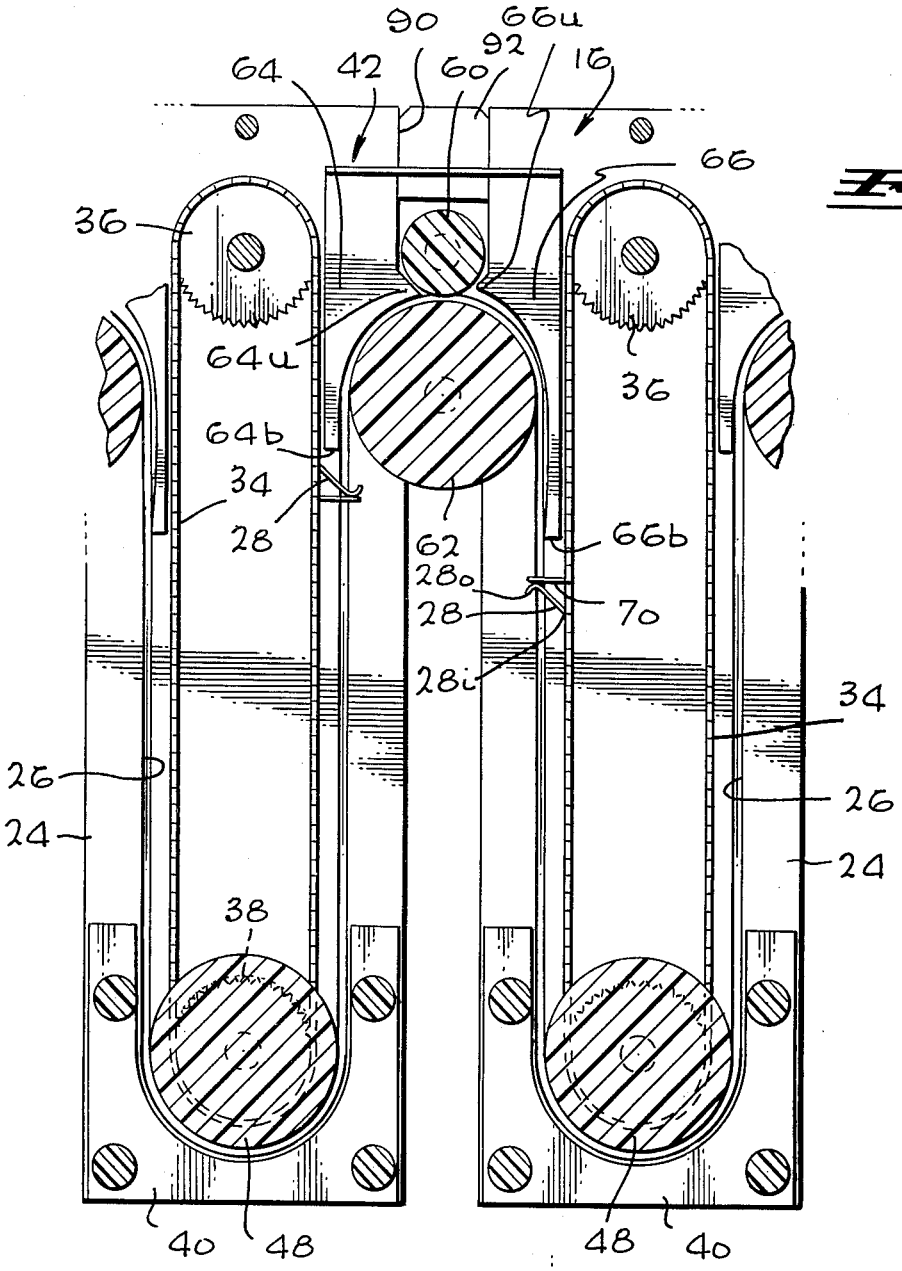
FIG. 4 is a partial side elevation view of the transport of FIG. 2.

The upper loop guide transfer devices 42, best shown in FIGS. 3 and 4, also includes a pair of plates 50, 52 with plate edges which engage and guide the leading edges of film sheets about the loop. The transfer device 42 also serves to actually propel the sheet of film through the loop. Separate moving means for propelling the sheet through the transfer loop is required because the belts 34 which moves the push fingers 28, do not extend around the transfer loop. The moving means of the transfer device 42 includes a pair of horizontally-extending rollers 60, 62 which lightly grip the film sheet between them, with the lower roller 62 being driven. The roller 62 is driven at a speed which is great enough that its periphery moves faster than the push fingers 28 of the belts, so that after the leading edge of the film sheet is gripped between the rollers 60, 62 it "walks away" from the push finger 28 which is pushing the rear end of the sheet. It can be seen in FIG. 4 that the transfer guide plates or guides such as 50 include an up portion 64 which guides the edge of a sheet moving up out of the tank and a down portion 66 which guides the leading edge of the sheet as it moves down into the next tank, the film-engaging surfaces of each guide extending in a smooth concave curve. The lower ends 64*b*, 66*b* of the guide surfaces lie over different tanks. The upper ends 64*u*, 66*u* of the up and down guide surface portions that engage the film, both lie slightly above the bottom of the roller 60. The beginning of the down portion 66*u* lies higher than the portion 64*u*, because the location 66*u* must receive a sheet which tends to flex outwardly as it leaves the roller 60. Thus, the leading edge of a sheet is smoothly transferred by the roller 60 from the up guide 64 to the down guide 66. The transfer device 42 is constructed as a single unit which is slideably mounted in slots 90 formed in the transport so that the force of the roller 60 against a film is merely equal to the weight of the transfer device which includes a weighting bar 92 to provide the necessary weight.

The push finger 28 (FIG. 3) has an inner end 28*i* which is pivotally mounted on the chain belt 34, and also has an outer end portion 28*o* which is concave. The concave outer end 28*o* serves to minimize deflection or bowing of the trailing edge of the sheet due to the pushing force applied to it. The pivotal mounting of the inner end 28*i* serves to allow the push finger to slightly adjust its position to always engage the rear edge of the film sheet at the deepest portion of the concave outer end 28*o*. In addition to the push fingers 28, hold fingers 70 are provided immediately behind each push finger. The hold fingers 70 serve to support the leading edge of a film sheet so that it will not fall directly onto the rearward side of a push finger 28 whose forward side is engaged with another sheet, inasmuch as this could lead to the leading edge of the rearward sheet bending inwardly and jamming against the inner end 28*i* of a push finger. A support finger 70 is not required behind the push finger of the first belt 34*a* which receives film sheets falling through an opening 72 of a film cartridge holder 74, because the dropping of sheets through the opening 72 is timed so that a film sheet does not fall onto the rear of a push finger 28.

A technician operates the film processor 10 by first loading a cartridge 18 containing a stack of film sheets 32 to be processed in the cartridge holder 74, and then depressing a start button (not shown) to start the motor which drives the chain belt rollers 36 and lower transfer rollers 62. At intervals, the cartridge receiving device 74 drops a new film sheet through the opening 72 so that it falls down along the film path to the position shown at 32 in FIG. 2. A short time later, the first push finger at 28 engages the rear edge of the film sheet and pushes it down around the lower loop of the first tank and up out of the tank and into the first transfer device 42. The first transfer device moves the sheet around the transfer loop and drops it along the film path portion leading into the second tank, so that the push finger moving therealong will engage the rear end of the film sheet and push it. This continues until the film sheet moves out of the dryer tank 14. The sheet is then transferred onto a pair of belts 80 extending near either edge of the film path, and above a lamp 82 and under an opening 84 where the developed film sheet can be viewed. The sheet is then dropped into the box 22 for later retrieval.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. Apparatus for processing a sheet of film by moving it through tanks containing processing solutions comprising:

means defining a sheet path which includes a plurality of loop portions, each leading down into and up out of one of said tanks, said means comprising a pair of parallel edge guide means extending along said path for engaging opposite side edge portions of said sheet of film;

a plurality of push fingers;

a plurality of support fingers; and belt means for moving each of said push and support fingers along at least one of said loop portions to push sheets of film therealong;

each of said push fingers being movable with respect to said belt means, and each of said support fingers located immediately behind one of said push fingers along the length of said path, to stop the downward fall of a film sheet onto a push finger.

2. The apparatus described in claim 1 wherein:

each of said push fingers is pivotally mounted on said belt means and has a concave end portion facing forwardly along said path.

* * * * *